US006851464B2

(12) United States Patent
Hudoba et al.

(10) Patent No.: US 6,851,464 B2
(45) Date of Patent: Feb. 8, 2005

(54) STORM CURTAIN APPARATUS

(75) Inventors: Mark S. Hudoba, Gulf Breeze, FL (US); Stephen J. Borona, Pensacola, OH (US)

(73) Assignee: Wayne-Dalton Corp., Mt. Hope, OH (US)

( * ) Notice: Subject to any disclaimer, the term of this patent is extended or adjusted under 35 U.S.C. 154(b) by 0 days.

(21) Appl. No.: 10/352,152

(22) Filed: Jan. 27, 2003

(65) Prior Publication Data

US 2004/0144498 A1 Jul. 29, 2004

(51) Int. Cl.[7] ..... A47H 1/00
(52) U.S. Cl. ..... 160/31
(58) Field of Search ..... 160/31, 273.1, 160/268.1, 270, 271, 272, 23.1, 84.06

(56) References Cited

U.S. PATENT DOCUMENTS

| | | | | |
|---|---|---|---|---|
| 1,612,261 A | | 12/1926 | Burns | |
| 2,094,790 A | * | 10/1937 | Gottert | 160/31 |
| 3,797,553 A | * | 3/1974 | Elliott | 160/267 |
| 4,282,919 A | * | 8/1981 | Teno | 160/23.1 |
| 4,357,978 A | * | 11/1982 | Keller et al. | 160/271 X |
| 4,665,964 A | * | 5/1987 | Zommers | 160/84.06 |
| 5,096,250 A | | 3/1992 | Menz | |
| 5,163,495 A | | 11/1992 | Lichy | |
| 5,351,742 A | | 10/1994 | Lichy | |
| 5,445,209 A | | 8/1995 | Lichy | |
| 5,477,902 A | * | 12/1995 | Kraeutler | 160/84.06 |
| 5,671,790 A | | 9/1997 | Andersen | |
| 5,765,622 A | * | 6/1998 | Lichy | 160/273.1 |
| 5,868,191 A | | 2/1999 | Blackmon, Jr. | |
| 5,964,270 A | | 10/1999 | Kirkey | |

FOREIGN PATENT DOCUMENTS

| | | |
|---|---|---|
| FR | 764430 | 11/1936 |
| GB | 1175772 | 12/1969 |
| SE | 201032 | 1/1966 |

OTHER PUBLICATIONS

Armor Screen Web Page, www.armorscreen.com Dated Jul. 29, 2001, 8 Pages.

Armor Screen Web Page, www.armorscreen.com, Dated Dec. 5, 2003, 11 Pages.

Phantom Screen Web Page, www.phantomscreens.com Dated Dec. 5, 2003, 22 Pages.

Phantom Screen Make You Home an Oasis, Copyright 2002, 2 Pages.

Skeetr–Beatr Web Page, www.sketr–beatr.com, Dated Dec. 5, 2003, 16 Pages.

Shy About Us, 343 Page Color Brochure.

Shy Zip Screen, 4 Pages.

(List continued on next page.)

*Primary Examiner*—David Purol
(74) *Attorney, Agent, or Firm*—Woodling, Krost and Rust

(57) ABSTRACT

A storm curtain apparatus is disclosed and claimed which includes a curtain having a left side edge, a right side edge and a bottom. A curtain bar is affixed to the bottom of the curtain. End caps are affixed to each end of the curtain bar and strips are affixed to the side edges of the curtain. A supporting frame includes first and second side guides, a top support and a bottom support affixed to the side guides. Each of the side guides include a generally rectangularly shaped and longitudinally extending body. Each body of each side guide includes a longitudinally extending curtain track and slot and a longitudinally extending guide track and slot. The curtain is movable between a first, stored, position and a plurality of second, deployed, positions. The edges of the curtain with the strips affixed thereto reside in the curtain tracks and slots and the end caps partially reside in the guide slots.

12 Claims, 11 Drawing Sheets

U.S. PATENT DOCUMENTS

| | | | |
|---|---|---|---|
| 5,996,669 | A | 12/1999 | Miller |
| 6,176,050 | B1 | 1/2001 | Gower |
| 6,257,305 | B1 | 7/2001 | Mullet |
| 6,296,039 | B1 | 10/2001 | Mullet |
| 6,341,639 | B1 | 1/2002 | Mullet |
| 6,378,593 | B1 | 4/2002 | Mullet |
| 6,408,922 | B2 | 6/2002 | Descrochers |
| 6,431,250 | B2 | 8/2002 | Mullet |
| 6,478,070 | B2 | 11/2002 | Poppema |
| 6,523,596 | B1 | 2/2003 | Mullet et al. |
| D482,129 | S | 11/2003 | Hudoba |

* cited by examiner

STORM CURTAIN APPARATUS

FIELD OF THE INVENTION

The invention is in the field of storm curtains sometimes referred to as windlocking curtains or hurricane curtains.

BACKGROUND OF THE INVENTION

Storm curtains are used to protect buildings during violent storms such as hurricanes. U.S. Pat. No. 6,241,639 B1 (Apparatus And Method For Windlocking A Building Opening), U.S. Pat. No. 6,296,039 B1 (Apparatus And Method For Windlocking A Building Opening), U.S. Pat. No. 6,257,305 B1 (Method And Apparatus For Driving And Storing A Covering) U.S. Pat. No. 6,378,593 B1 (Access Panel For Operating An In Wall Curtain System And Method Of Using Same), and U.S. Pat. No. 6,431,250 B2 (Apparatus And Method For Windlocking A Building Opening) assigned to Wayne-Dalton Corp. disclose, among other things, building construction industry requirements for hurricane-prone areas such as Florida and the Gulf of Mexico States. The disclosures of the aforementioned patents are incorporated herein by reference hereto. Further the aforementioned patents describe wind conditions during hurricanes and other violent storms.

When a building envelope is breached devastating pressure differentials cause large amounts of damage. Kinetic energy due to the velocity of the fluid (wind) is proportional to the square of the velocity. Energy from the wind, therefore, pressurizes the interior of a home or other structure which in combination with the profile of the roof makes the roof, in effect, act like an airplane wing causing it to blow off the remaining structure.

During a storm, wind applied to a building or a building opening such as a door or a window is not constant. Wind varies and fluctuates in magnitude (force) and direction with respect to time during, before and after a storm. While it is desirable to deploy protective devices before violent winds attack a building such deployment does not always occur. Sometimes deployment of the protective devices occurs during conditions which are quite windy.

The present invention provides a full perimeter seal by virtue of the curtain engaging the storm curtain canister, the side guides and the sill.

Therefore, there is a need to have a storm curtain frame which is capable of being deployed in stormy conditions while the wind is blowing, fluctuating and varying. There is also a need for a storm curtain which provides strength and rigidity during a storm.

Therefore, there is a need to have a storm curtain which has a bottom bar affixed to the curtain which stablizes the curtain during deployment, for example, raising and lowering the curtain as well as full deployment of the curtain in the completely lowered position.

The invention described and claimed hereinbelow solves the aforementioned problems and others.

SUMMARY OF THE INVENTION

A storm curtain apparatus is disclosed and claimed which includes a curtain having a left side edge, a right side edge and a bottom. A curtain bar is affixed to the bottom of the curtain. The curtain is preferably a polymeric curtain and can be single ply, double ply or triple ply. The strips affixed to the edges of the curtain are preferably polymeric and can be glued, welded ultrasonically, rf welded, microwave welded, or induction welded as disclosed in patent application Ser. No. 10/322,965 filed Dec. 18, 2002, entitled Method and Apparatus For Manufacturing A Flexible Curtain. Alternatively, the curtain may be made out of another material such as a woven material or a material being a composite which includes Kevlar®, a trademark of Dupont.

Nylon end caps are affixed to each end of the curtain bar and strips are affixed to the side edges of the curtain. A supporting frame includes first and second side guides, a top support and a bottom support affixed to the side guides. Each of the side guides include a generally rectangularly shaped and longitudinally extending body. Each body of each side guide includes a longitudinally extending curtain track and curtain slot and a longitudinally extending guide track and guide slot. The longitudinally extending curtain track is in communication with the longitudinally extending curtain slot. Likewise, the longitudinally extending guide track is in communication with the longitudinally extending curtain slot.

The curtain is movable between a first, stored, position and a plurality of second, deployed, positions. Ordinarily the curtain will be either fully open in good weather conditions or fully closed in storm conditions. The edges of the curtain with the strips affixed thereto reside in the curtain slots and the end caps partially reside in the guide slots.

It is an object of the present invention to provide a frame assembly which provides stability and guidance when lowering the curtain from the first position (open) to the second position (closed) during storm conditions.

It is an object of the present invention to provide a frame assembly which assists in stabilizing when it is lowered from the curtain from the first position (open) to the second position (closed) during storm conditions.

It is an object of the present invention to provide a frame assembly which includes longitudinally extending side guides having longitudinally extending curtain tracks and slots and longitudinally extending guide tracks and guide slots. It is a further object of the present invention to stabilize the guides with a bottom sill and a canister (top support) from which the curtain may be dispensed and stored.

It is an object of the present invention to provide a frame assembly which in combination with a curtain having edges and strips affixed thereto retains the curtain under wind load.

It is an object of the present invention to provide a frame assembly which guides the curtain with minimal friction as the curtain is lowered from its first, open position to its second, closed position. The curtain has edges with strips affixed thereto. The curtain and strips reside in curtain slots in each side guide of the frame. A bottom bar having end caps on each end thereof is affixed to the curtain. Each of the end caps slidingly engage a guide slot in each of the side guides. End caps engage the guide slots and the curtain and strips attached thereto engage the curtain slots and enable raising and lowering the curtain with wind buffeting the curtain.

It is an object of the present invention to provide a frame assembly which includes a bottom sill for supporting the curtain and the curtain bar when the curtain is fully deployed, i.e., when the curtain is in its second position. In its second position the bottom of the curtain, which is attached to and supported by the curtain bar, rests against the sill of the frame.

It is an object of the present invention to provide a lightweight curtain bar affixed to the curtain which adds rigidity to the curtain and prevents flapping of the curtain in the wind when it is deployed.

These and additional objects of the invention will be best understood when reference is made to the Brief Description of the Invention and Claims which follow herein below.

Figure 1:
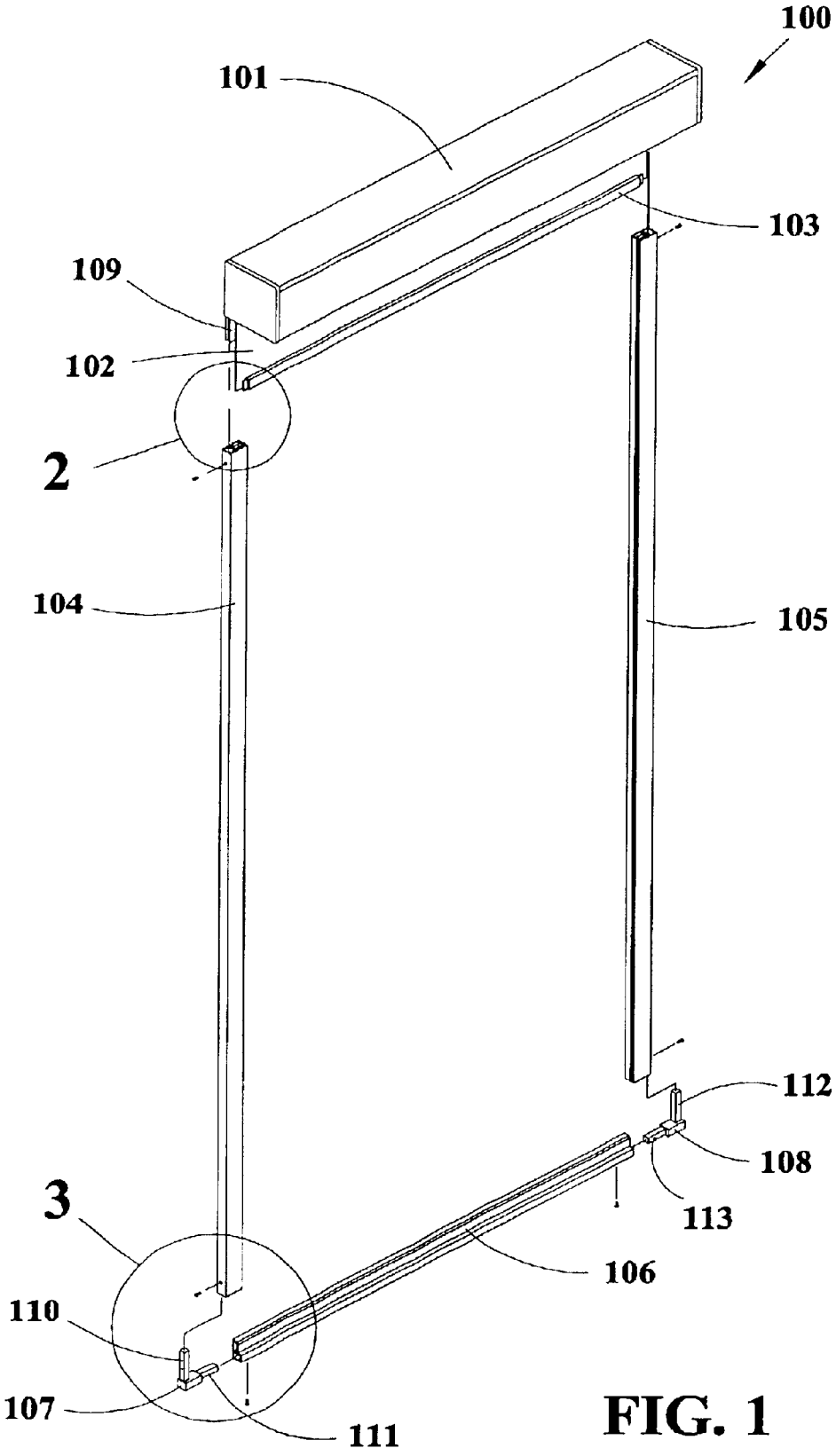
FIG. 1 is an exploded perspective view of the storm curtain apparatus.

A better understanding of the drawing figures will be had when reference is made to the Description of the Invention and Claims which follow hereinbelow.

DESCRIPTION OF THE INVENTION

FIG. 1 is an exploded perspective view 100 of the storm curtain apparatus illustrating, among other things, the storm curtain 102, storm curtain canister 101, side guides 104, 105, curtain bar 103, and sill 106. The storm curtain canister, side guides and sill from a frame which is secured to a building adjacent an opening such as a window or door. The frame resides to the exterior of the opening and is oriented with the canister facing outward toward the exterior and the outdoor environment as is illustrated in FIG. 1.

Alternatively, the frame may be oriented in the opposite direction with the curtain storm canister oriented toward the building. Although orienting the frame in this reverse manner creates some issues in regard to drainage and the like, it has the benefit of a flat surface projection.

Side guides 104, 105 extend longitudinally while storm curtain canister 101 and sill 106 extend latitudinally. Top key 109 (top post) is shown in position to interengage left side guide 104. Corner keys 107 and 108 are illustrated which secure sill 106 to the left side guide 104 and the right side guide 105, respectively. Specifically, vertical portion 110 of corner key 107 interengages left side guide 104, horizontal portion 111 of corner key 107 interengages bottom sill 106, vertical portion 112 of corner key 108 interengages right side guide 105 and horizontal portion 113 of corner key 108 engages sill 106. Another top key exists for the securement of side guide 105 to the storm curtain canister 101 but it is not shown due to the perspective nature of FIG. 1. Screws (unnumbered) secure the keys to the respective parts as illustrated in FIG. 1.

Figure 2:
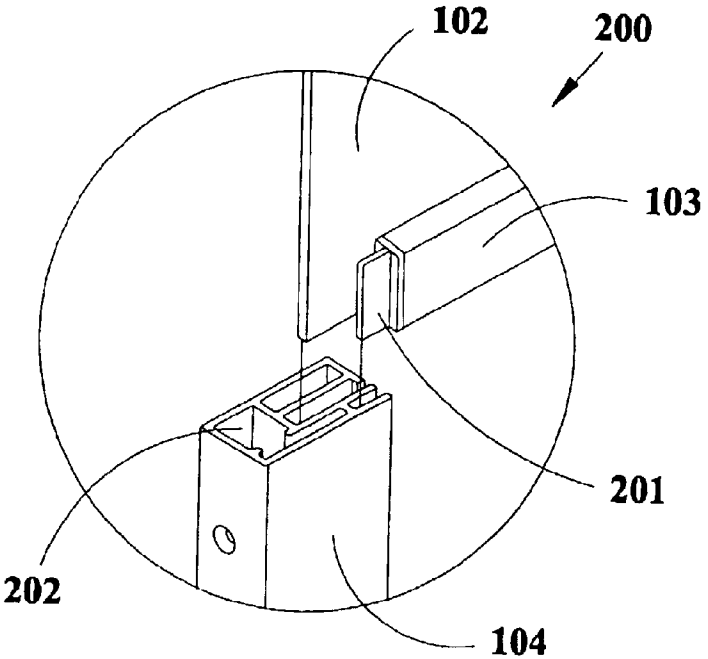
FIG. 2 is an enlarged portion of FIG. 1 illustrating the relationship of the curtain and end cap to a side guide.

FIG. 2 is an enlarged portion 200 of FIG. 1 illustrating the relationship of the curtain 102 and end cap 201 to side guide 104. End cap 201 is press fit into curtain bar 103 as illustrated. Channel 202 in side guide 104 receives top key 109. A screw (unnumbered) secures the top key to the side guide 104.

Figure 3:
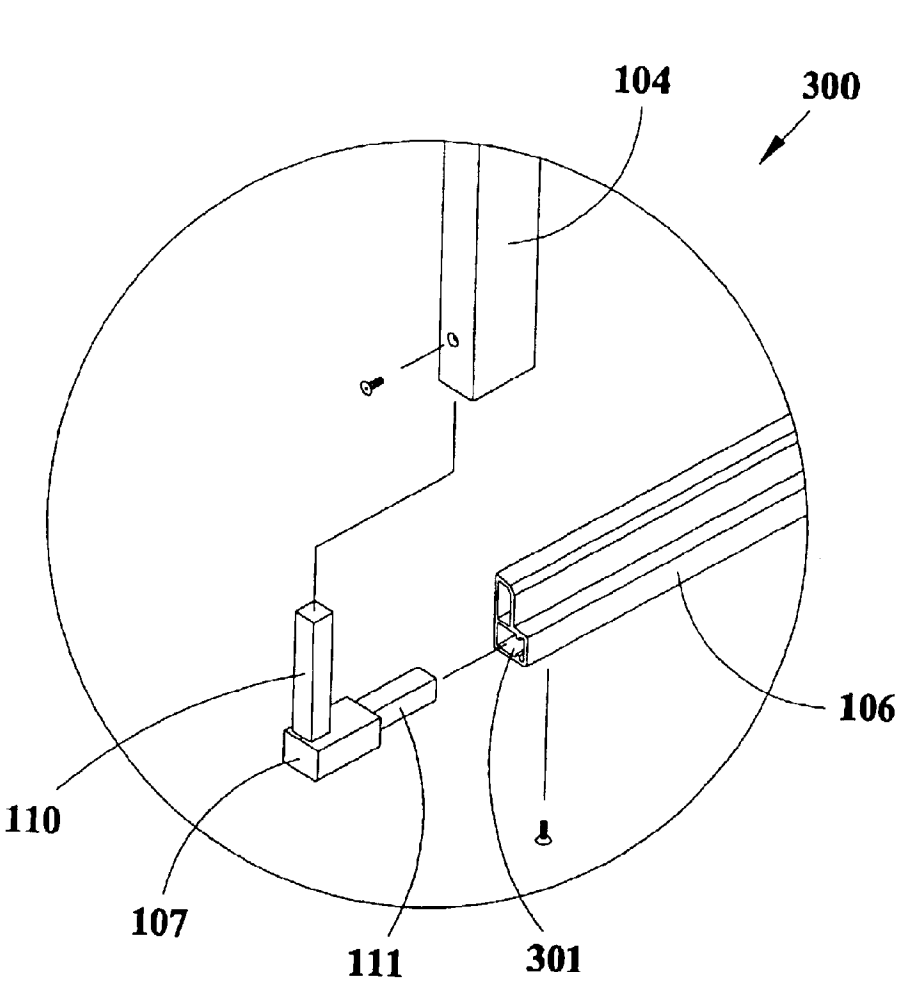
FIG. 3 is an enlarged portion of FIG. 1 illustrating the assembly of the sill and the side guide.

FIG. 3 is an enlarged portion 300 of FIG. 1 illustrating the assembly of the sill 106 and the side guide 104 with corner key 107. FIG. 3 illustrates channel 301 in sill 106 which receives horizontal portion 111 of corner key 107. Vertical portion 110 interengages channel 202 of side guide 104.

Figure 4:
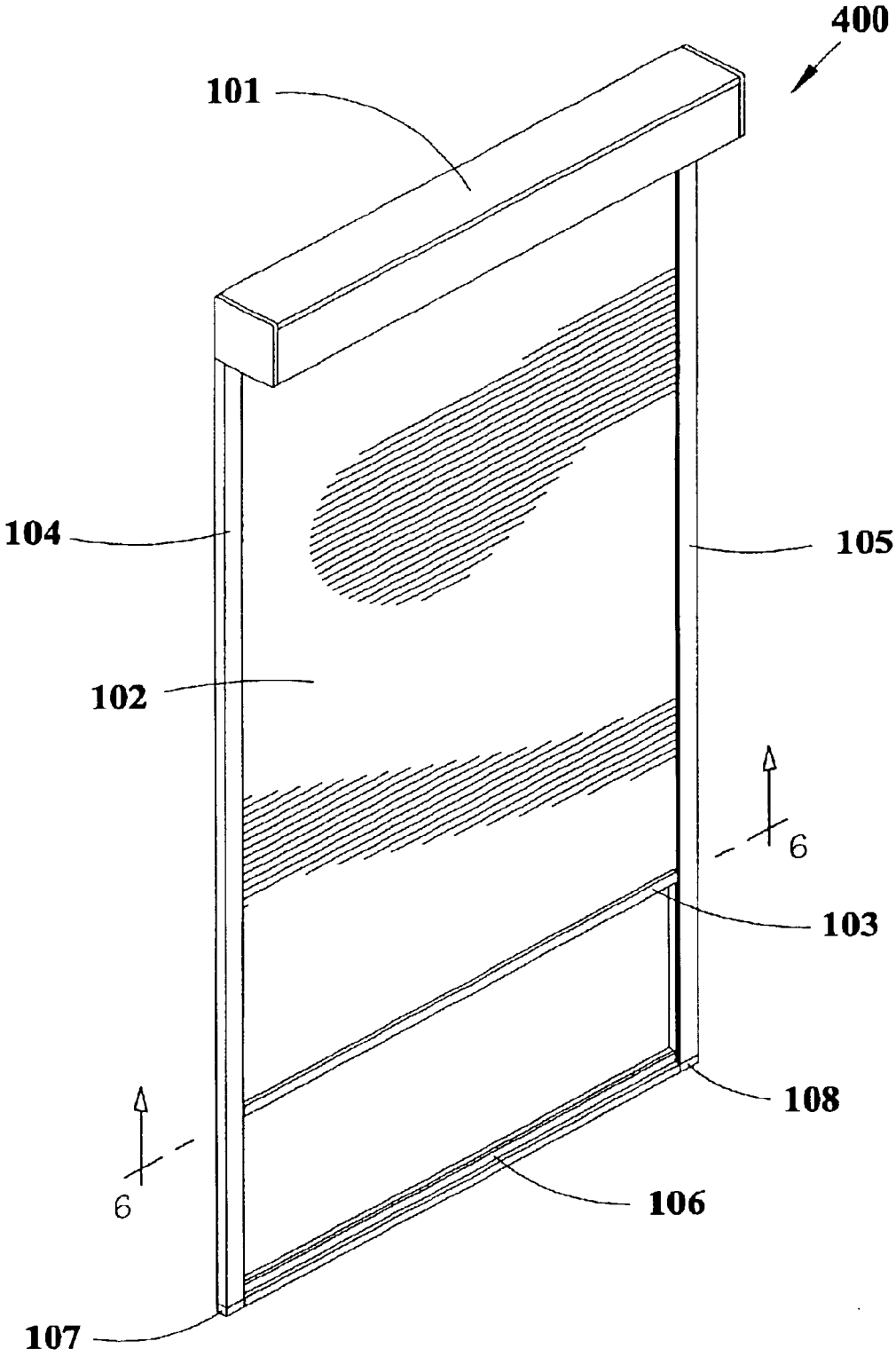
FIG. 4 is a perspective view of the storm curtain apparatus with the curtain dispensed approximately three-fourths of the way down.
Figure 4A:
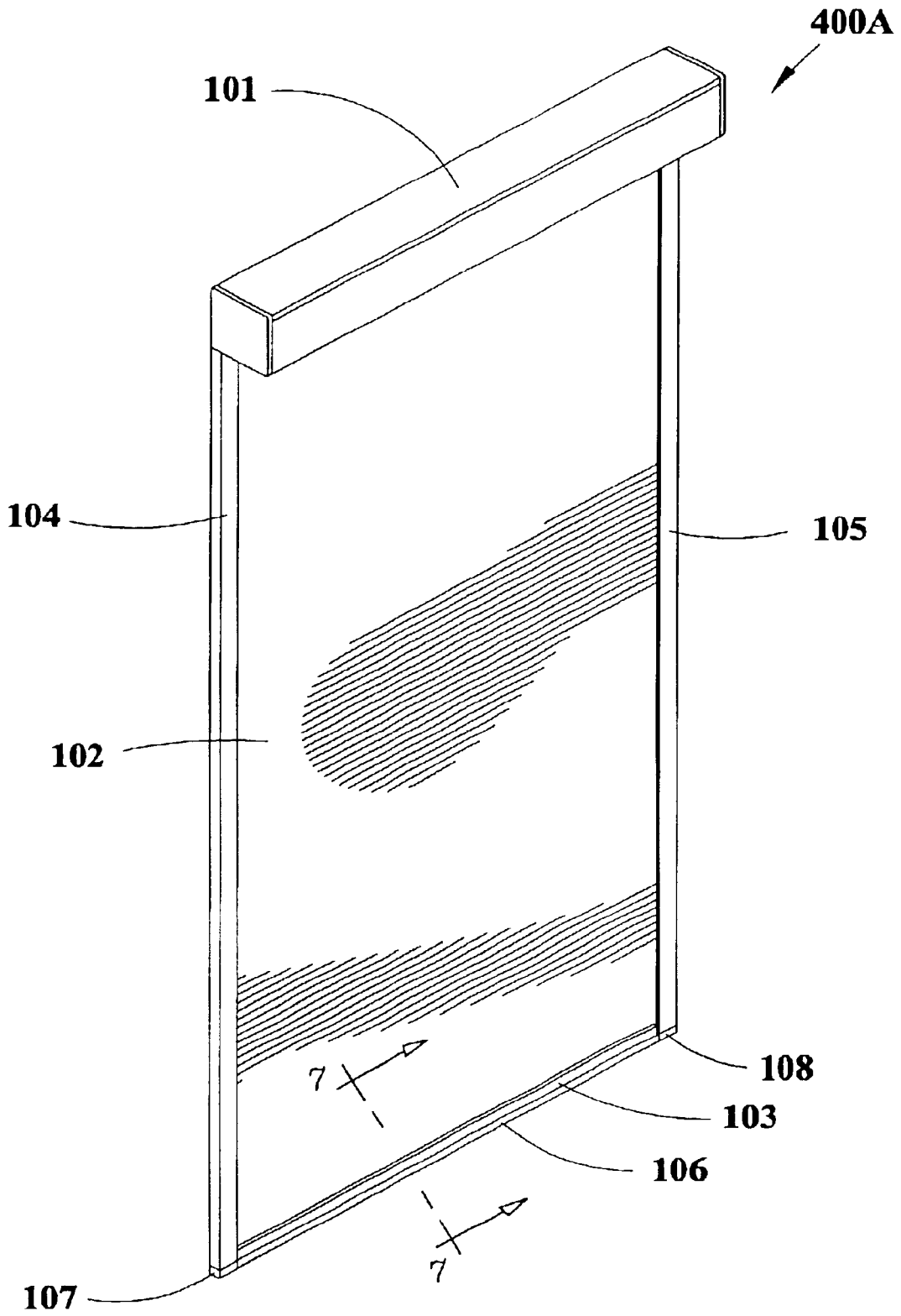
FIG. 4A is a perspective view of the storm curtain apparatus with the curtain fully dispensed.

FIG. 4 is a perspective view 400 of the storm curtain apparatus with the curtain dispensed approximately three-fourths of the way down. Bottom bar 103 which is preferably made of aluminum stabilizes curtain 102 as it moves downwardly from a stored position substantially within canister 101 to the fully dispensed position as illustrated in FIG. 4A. Side guides 104, 105 are also made of aluminum as is the canister 101 and sill 106.

FIG. 4A is a perspective view 400A of the storm curtain apparatus with the curtain fully dispensed.

Figure 5:
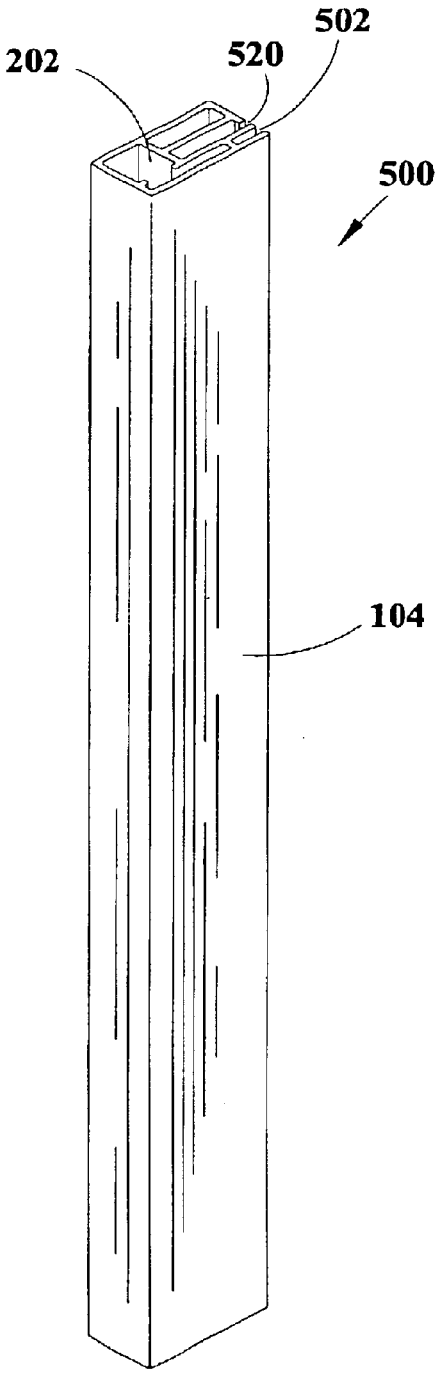
FIG. 5 is a perspective view of a side guide.
Figure 5A:
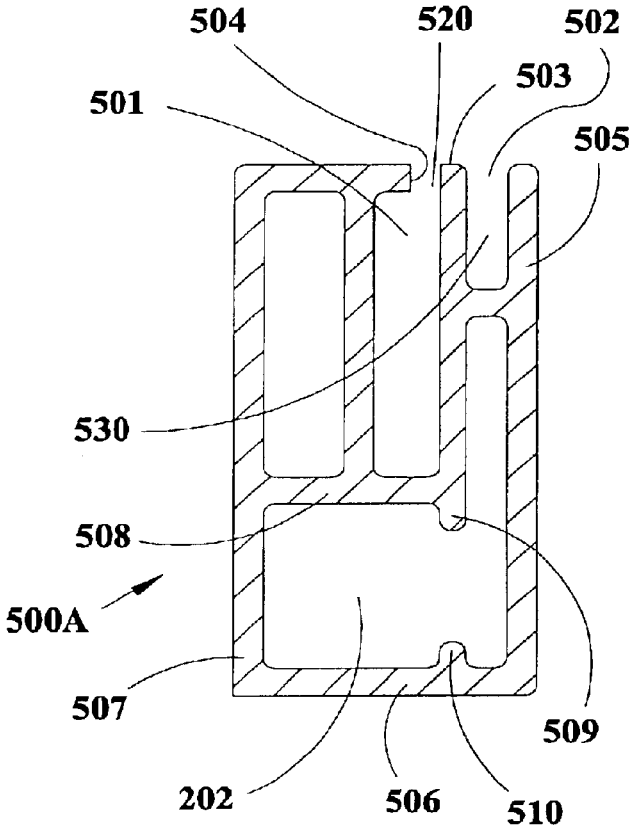
FIG. 5A is a cross-sectional view of a side guide.

FIG. 5 is a perspective view 500 of a side guide such as side guide 104 illustrated in FIG. 1. Side guide 105 as illustrated in FIG. 1 is identical to side guide 104 illustrated in FIG. 5. FIG. 5A is a cross-sectional view 500A of a side guide. The side guides are generally rectangularly shaped in cross-section and extend longitudinally. The side guides include a longitudinally extending channel 202, a longitudinally extending curtain track 501, and a longitudinally extending guide track 530. A longitudinally extending curtain slot 520 is formed by walls 503 and 504 and a longitudinally extending guide slot 502 is formed by walls 503 and 505. Curtain slot 520 is in communication with curtain track 501 and guide slot 502 is in communication with guide track 530.

Channel 202 is formed by first 506, second 507 and third 508 longitudinally extending walls and first 509 and second 510 protrusions. Channel 202 receives top key 109 and bottom key 107 which are reciprocally shaped. The generally all aluminum construction is painted white with paint that can be applied 2–3 thousandths of an inch thick and does not run so as to minimize unwanted paint bumps and the like. However, those skilled in the art will readily recognize that any smooth finish paint is satisfactory.

The curtain 102 of the invention is preferably a single ply polymeric curtain. However, the curtain may be a multi-ply polymeric curtain or some other type of curtain which is impervious to the passage of water under high pressure. The strips which are affixed to the edges of the curtain are preferably a polymeric material but those skilled in the art will recognize that they may be made from suitable non-polymeric materials. The strips may be affixed to the curtain in a multiplicity of ways such as those set forth in co-pending application Ser. No. 10/322,965 filed Dec. 18, 2002 which is incorporated herein by reference. The curtain may contain apertures in the edges which extend through the polymeric strips affixed to the edges. Alternatively, the curtain 102 and strips 601 may include notches which do not extend through the curtain and strips and which enable the curtain to be driven essentially by a gear having teeth which coact with the notches.

Figure 6:
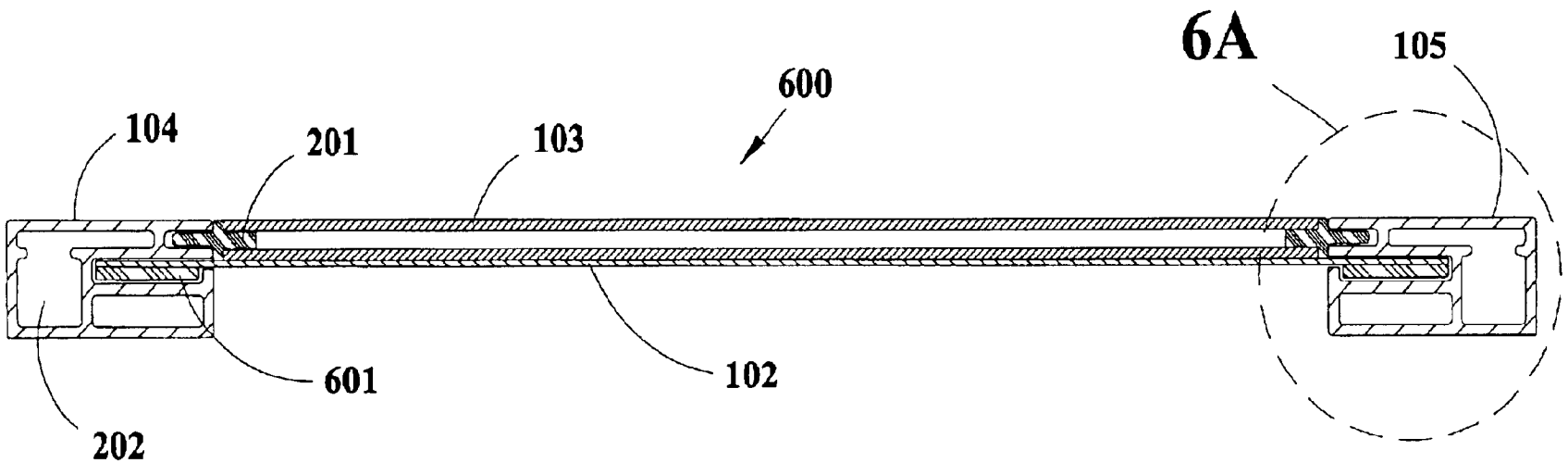
FIG. 6 is a cross-sectional view taken along the lines 6—6 of FIG. 4.

FIG. 6 is a cross-sectional view 600 taken along the lines 6—6 of FIG. 4 and illustrates left 104 and right 105 side guides, curtain 102, and strips 601 affixed to the curtain 102. Curtain 102 has clearance between walls 503 and 504 which form the curtain slot. Likewise, the curtain strip 601 and curtain 102 have clearance within curtain track 501. In this way the curtain may move freely upwardly and downwardly in the curtain track 501 and the curtain slot 520 without excessive friction.

The letter "P" and the arrow associated therewith signify the direction from which pressure may be applied during a storm condition. As sufficient pressure is applied to the curtain, the curtain bends inwardly slightly and the strips 601 engage the curtain track 501.

During closure of the curtain some pressure may be applied to the curtain. The direction and magnitude of the pressure may be changing. End caps 201 guide curtain bar 103 and curtain 102 downwardly in the guide slot 502 and the guide track 530.

Figure 6A:
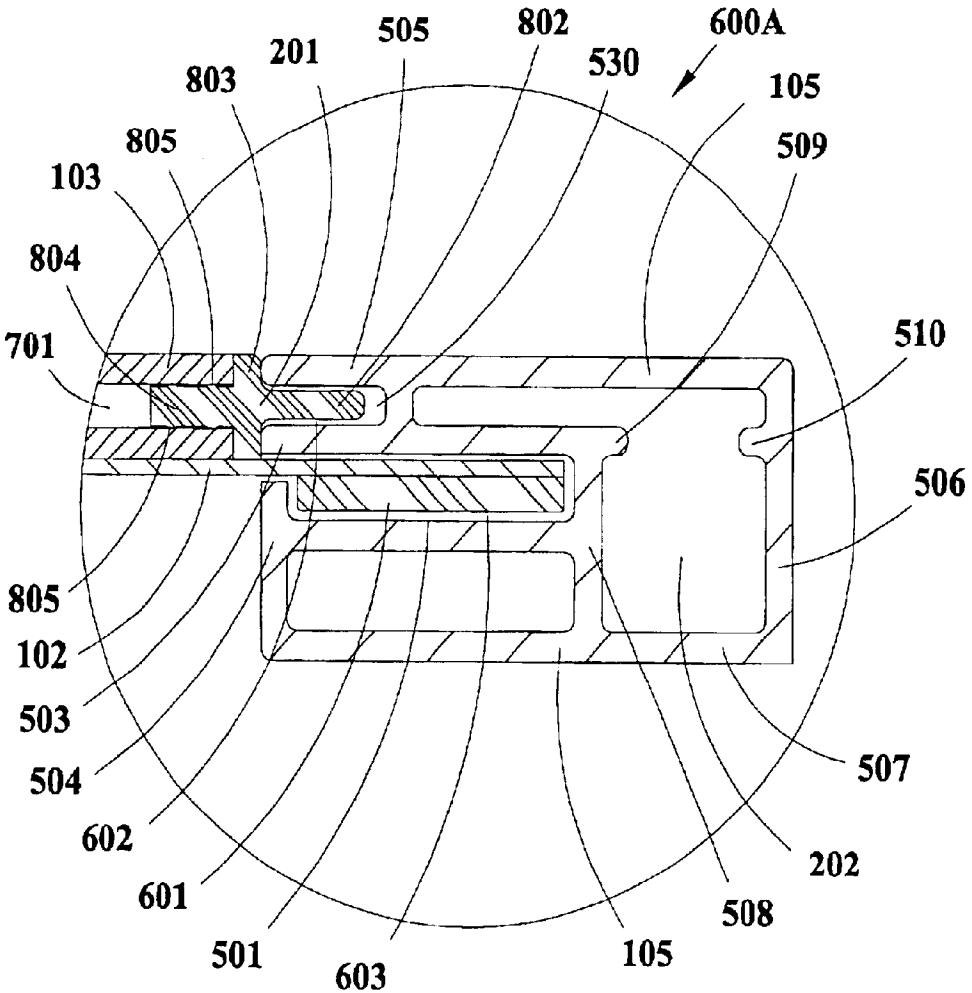
FIG. 6A is an enlargement of FIG. 6 illustrating a side guide having a curtain track and curtain slot as well as a guide track and guide slot, a curtain with a strip affixed to its edge residing in the curtain track, and an end cap protruding from the curtain bar and residing partially in the guide slot.

FIG. 6A is an enlarged portion 600A of FIG. 6 illustrating side guide 105 having a curtain slot 501 and a guide slot 530, a curtain 102 with a strip 601 affixed to its edge residing in the curtain slot 501, and an end cap 201 protruding from the curtain bar 103 which resides in the guide slot 502 and extends into the guide track 530. FIG. 6A illustrates ribs 805 on second end portion 804 of end cap 201 which are press fit into curtain bar 103. Ribs 805 fit tightly into channel 701 of curtain bar 103 as is best viewed in FIG. 7. Flange 803 of end cap 201 has the same outer shape as the curtain bar 103.

First end portion 802 of end cap 201 extends into guide track 530. Space or gap 602 exists between first end portion 802 and the walls 505 and 503 which form guide track 530.

Figure 7:
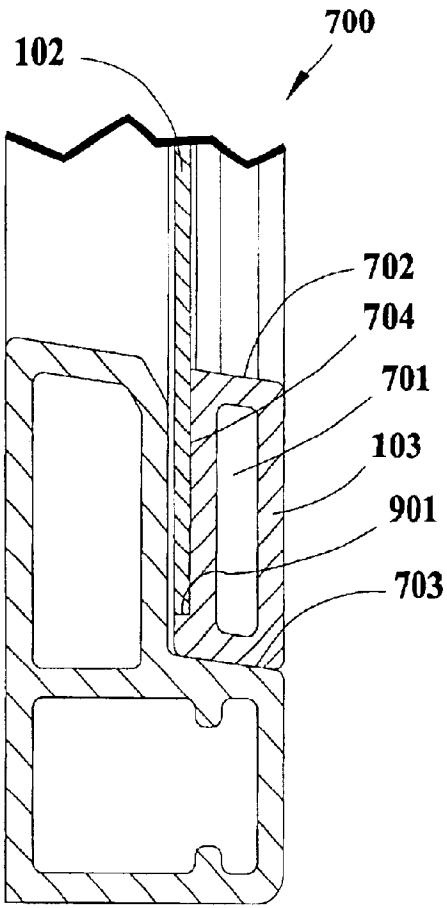
FIG. 7 is a cross-sectional view along the lines 7—7 of FIG. 4A.

FIG. 7 is a cross-sectional view 700 of the sill 106, curtain bar 103, and curtain 102 along the lines 7—7 of FIG. 4A. Curtain 102 sits on lip 901 of curtain bar 103 and is glued 704 at the interface between curtain 102 and bar 103. Other methods of attachment may be used such as mechanical fasteners and double-side tape. Curtain 102 also sits on the lip of the flange 803 of the end cap 201. Curtain bar 103 has an upper surface 702 which is sloped downwardly and outwardly so as to facilitate the drainage of water toward the outside of the storm curtain apparatus. Similarly, curtain bar 103 includes a lower surface 703 which is sloped downwardly and outwardly and which mates with the slope of the sill which also facilitates drainage when the curtain is partially or fully open.

Figure 7A:
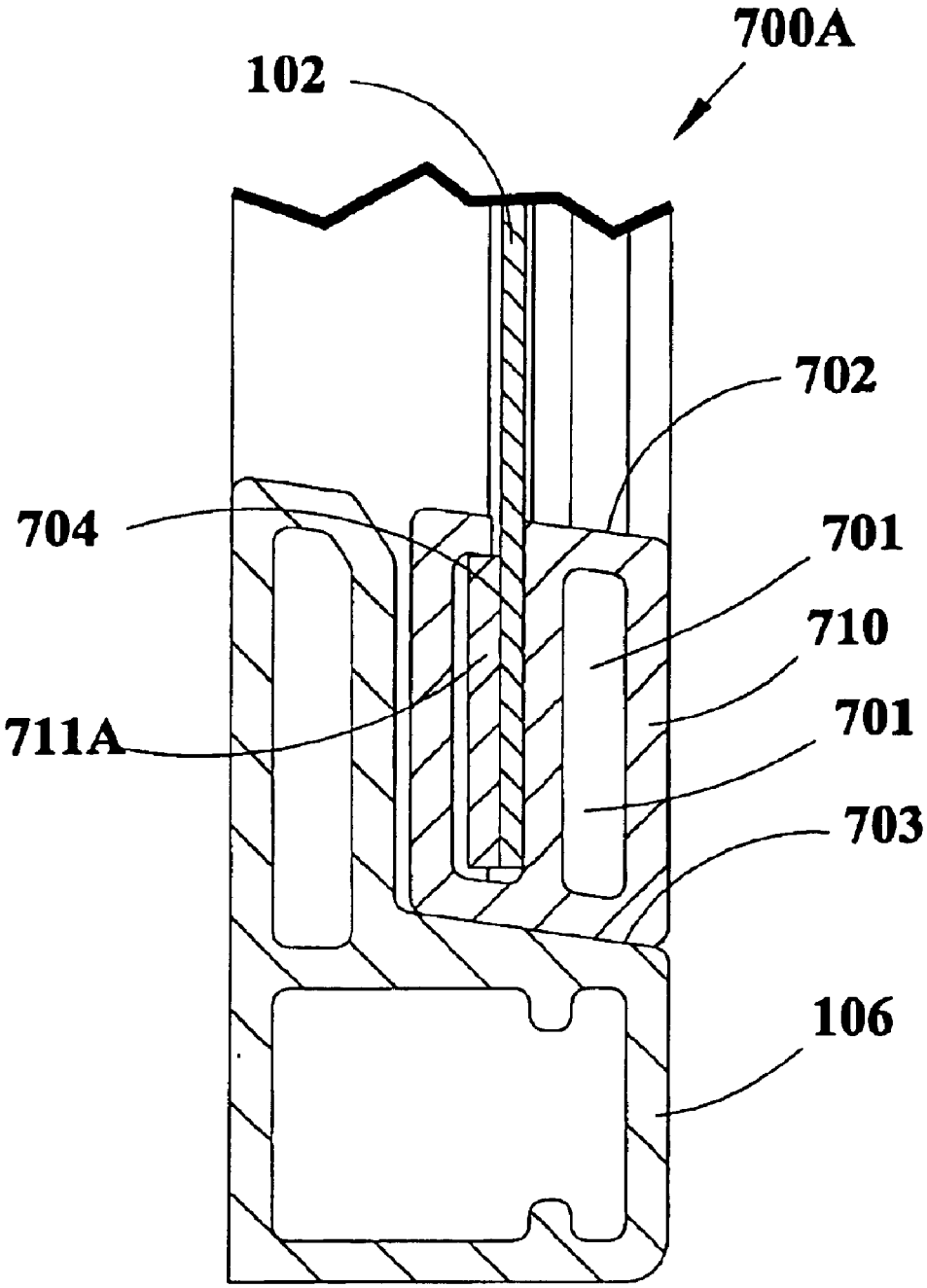
FIG. 7A another embodiment of a curtain bar.

FIG. 7A is another embodiment 700A of curtain bar 700A wherein curtain 102 is secured to the curtain by polymeric strip 711A which is affixed to the curtain 102.

Figure 7B:
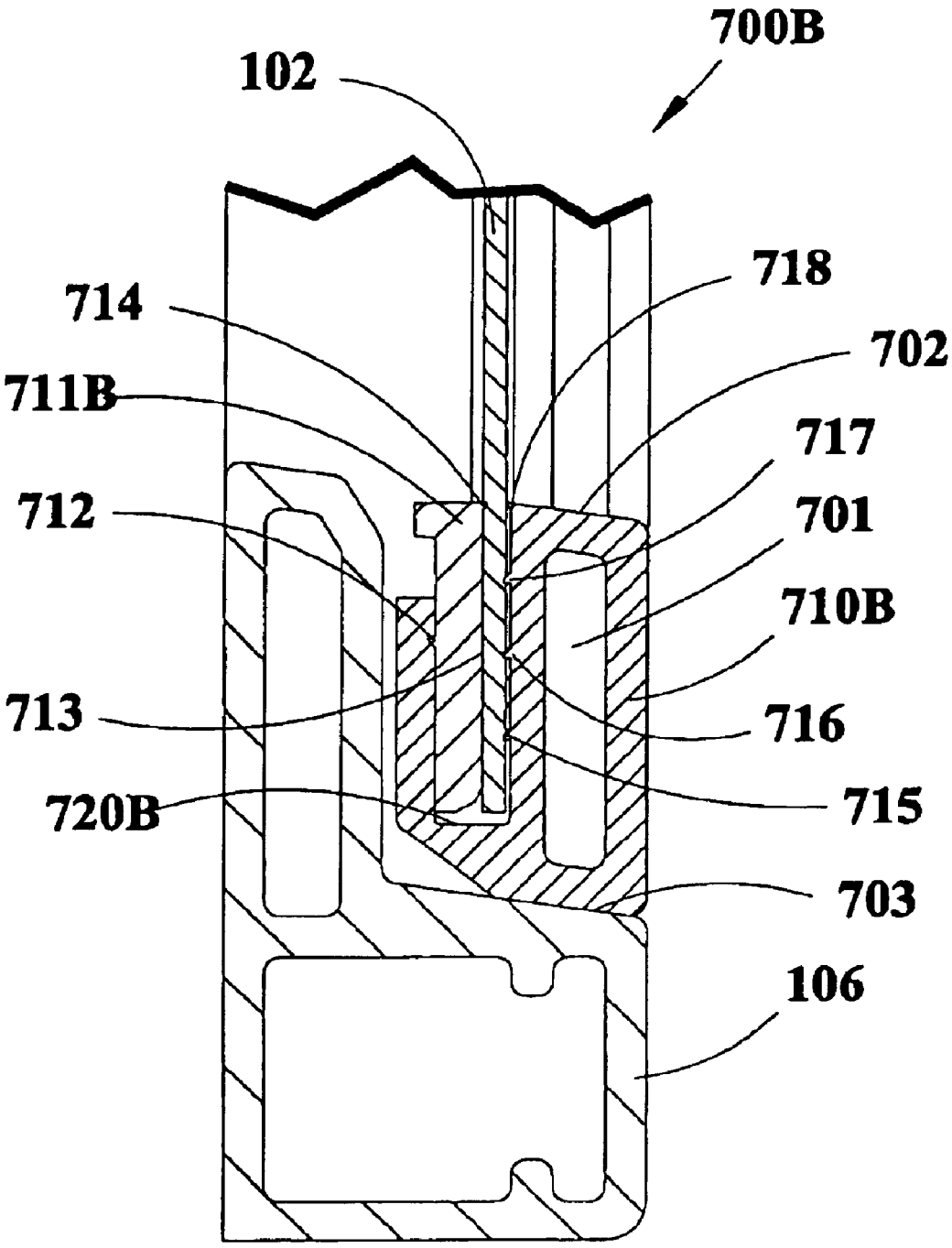
FIG. 7B is another embodiment of a curtain bar.

FIG. 7B is another embodiment 700B of a curtain bar 710B wherein curtain 102 is secured to the bar by the compressive force of wedge 711B and barbs 712, 713 and 714 thereon as well as barbs 715, 716, 717 and 718 on curtain bar 710B. Wedge 711B is forced into well 720B and forces the curtain into engagement with the respective barbs.

Referring to FIG. 6A, gap 603 intermediate curtain 102 and end strip 601 allows the curtain to be alternately dispensed and retracted as is deemed desirable. Further, gap 602 intermediate first end 802 of end cap 201 permits movement of first end 802 within guide track 530.

Figure 8:
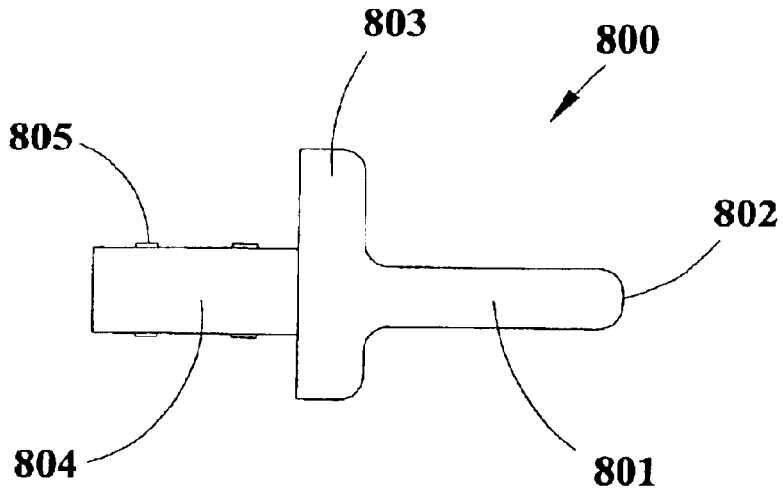
FIG. 8 is a plan view of an end cap.

FIG. 8 is a plan view 800 of an end cap 201. First end portion 802 of end cap 801 resides in the guide slot 502 of side guide 104, 105. Flange portion 803 of end cap 201 has the same profile as the curtain bar 103 in cross-section. Specifically, the end cap illustrated in FIG. 8A includes a lip 806 which matches the profile of the curtain bar 103 as illustrated in FIG. 7. The end cap illustrated in FIGS. 8 and 8A is for the left side of the curtain bar 103 and will plug into the channel 701 as illustrated in FIG. 7.

Since the end caps have a profile which matches the lip 901 on the curtain bar 103, the curtain snugly fits behind the curtain bar and the curtain and the bottom of the curtain bar form one planar surface. Second end portion 804 is press fit into channel 701 of curtain bar 103. Raised lands 805 on end portion 804 frictionally secure the end cap 801 to the curtain bar 103.

Figure 8A:
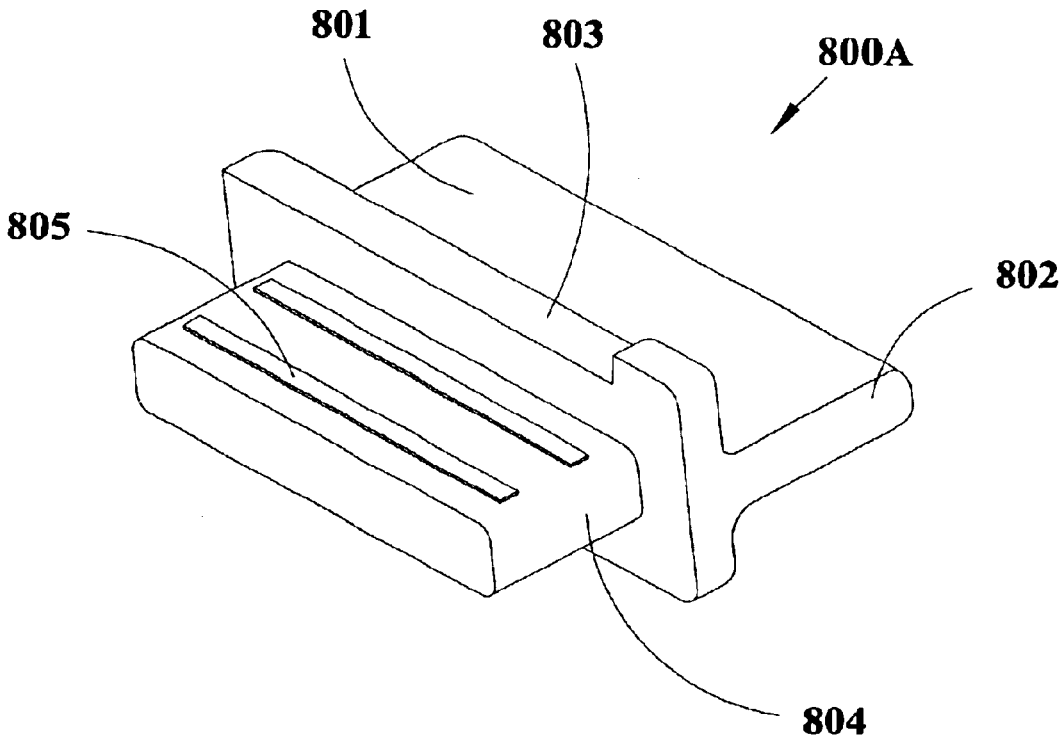
FIG. 8A is a perspective view of an end cap.
Figure 9:
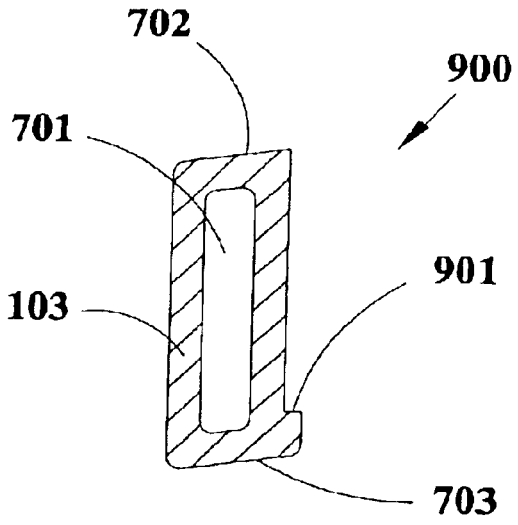
FIG. 9 is a cross-sectional view of the curtain bar.

FIG. 8A is a perspective view 800A of an end cap 201 which further illustrates the structure just described. FIG. 9 is a cross-sectional view 900 of the curtain bar. A lip 901 upon which curtain 102 is affixed is illustrated best in FIG. 9. Curtain 102 as illustrated in FIGS. 7 and 9 is equal in width to the lip so that the curtain 102 and the curtain bar 103 can function as described hereinbelow.

Figure 10:
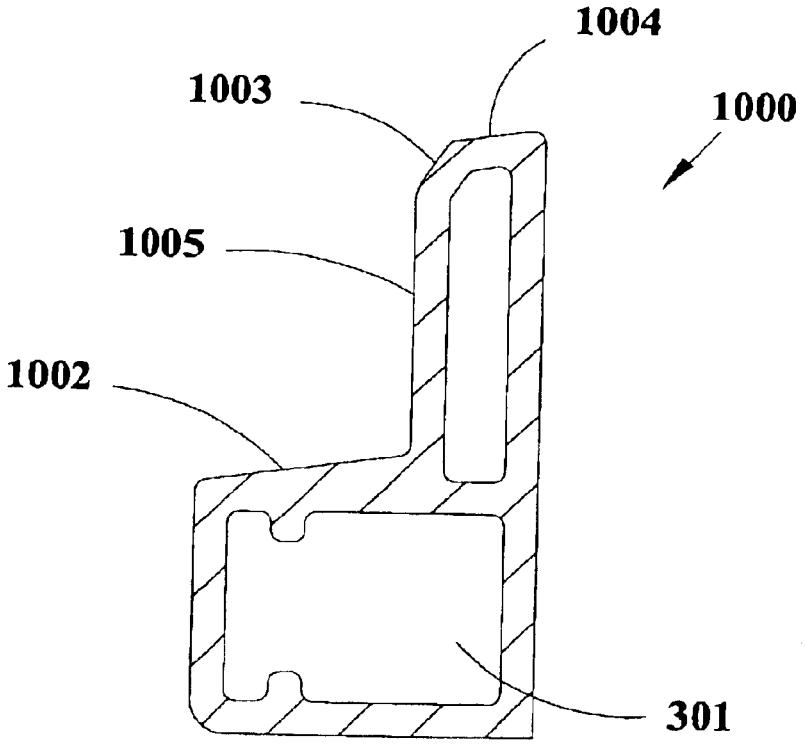
FIG. 10 is a cross-sectional view of the sill.

FIG. 10 is a cross-sectional view of the sill. Front 1001 of the sill is vertical and faces outwardly. Sloped surface 1002 permits drainage of water, snow and dirt mixed with water and snow. Intermediate sloped surface 1003 interconnects the top sloped surface 1004 with the vertical face 1005 of the sill.

While the invention has been described with particularity herein, those skilled in the art will recognize that changes may be made to the invention as described and disclosed herein without departing from the spirit and the scope of the appended claims.

We claim:

1. A storm curtain apparatus comprising: a curtain having a left side edge, a right side edge and a bottom; a curtain bar affixed to said bottom of said curtain; end caps, said end caps affixed to each end of said curtain bar; strips affixed to said side edges of said curtain; a frame; said frame includes first and second side guides; a top support and a bottom support affixed to said side guides; each of said side guides include a generally rectangularly shaped and longitudinally extending body; each said body of each said side guide includes a longitudinally extending curtain track and slot and a longitudinally extending guide track and slot; said curtain movable between a first, stored, position and a plurality of second, deployed, positions; said edges of said curtain and said strips affixed thereto reside in said curtain tracks and slots and, said end caps partially reside in said guide tracks and slots.

2. A storm curtain apparatus as claimed in claim 1 wherein said curtain bar is glued to said curtain.

3. A storm curtain apparatus as claimed in claim 1 wherein said curtain bar includes a channel and said end caps are press-fit into said channel.

4. A storm curtain apparatus as claimed in claim 1 wherein said curtain bar includes a wedge and barbs thereon and wherein said curtain bar is compressively affixed to said curtain by barbs and said wedge.

5. A storm curtain apparatus as claimed in claim 3 wherein said end caps include at least one rib thereon, said at least one rib frictionally engages said channel of said curtain bar.

6. A storm curtain apparatus as claimed in claim 1 wherein said bottom support is a sill.

7. A storm curtain apparatus as claimed in claim 1 wherein said top support is a canister.

8. A storm curtain apparatus as claimed in claim 1 wherein said curtain engages and seals against said curtain slots, said top and bottom supports to have a full perimeter seal.

9. A storm curtain apparatus as claimed in claim 7 wherein said top support is a curtain canister and said bottom support is a sill.

10. A frame for a storm curtain comprising: first and second side guides; each side guide includes a generally rectangularly shaped and longitudinally extending body;

each said body of each said side guide includes a longitudinally extending curtain track and slot and a longitudinally extending guide track and slot; and, a top canister and a bottom sill are affixed to said side guides.

11. A frame for a storm curtain as claimed in claim 10 wherein said guide slot resides to the exterior of said curtain slot.

12. A storm curtain apparatus comprising:

a frame structure comprising: first and second side guides; each side guide includes a generally rectangularly shaped and longitudinally extending body; each said body of each said side guide includes a longitudinally extending curtain track and slot and a longitudinally extending guide track and slot; a curtain storing and dispensing canister; and, a bottom sill affixed to said side guides;

a curtain comprising: side edges, a top and a bottom; each of said side edges includes a strip affixed to said curtain;

a curtain bar; said curtain bar affixed to said bottom of said curtain; said curtain bar having a first end and a second end; a first end cap and second end cap, each of said end caps includes a flange portion which interengages and is press fit into an end of said curtain bar; and, each of said end caps further includes a guiding portion which extends from said curtain bar;

and, said guiding portion of each of said end caps resides in its respective guide track and slot and each of said edges of said curtain having said strip affixed thereto resides in its respective curtain track and slot as said curtain is alternately dispensed and stored.

* * * * *

UNITED STATES PATENT AND TRADEMARK OFFICE

CERTIFICATE OF CORRECTION

PATENT NO. : 6,851,464 B2 
DATED : February 8, 2005
INVENTOR(S) : Mark S. Hudoba and Stephen J. Borona It is certified that error appears in the above-identified patent and that said Letters Patent is hereby corrected as shown below:

Column 5,
Line 18, after "curtain" delete "slot" and insert -- track --.
Line 18, after "guide" delete "slot" and insert -- track --.
Line 20, after "curtain" delete "slot" and insert -- track --.

Signed and Sealed this

Twenty-fourth Day of May, 2005

JON W. DUDAS
*Director of the United States Patent and Trademark Office*